US008622497B2

(12) United States Patent
Hiyoshi et al.

(10) Patent No.: US 8,622,497 B2
(45) Date of Patent: Jan. 7, 2014

(54) LIQUID EJECTION APPARATUS, DRIVE CIRCUIT THEREOF, AND DRIVE METHOD THEREOF

(75) Inventors: Teruyuki Hiyoshi, Izunokuni (JP); Noboru Nitta, Tagata-gun (JP); Mamoru Kimura, Numazu (JP); Tomohisa Yoshimaru, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 85 days.

(21) Appl. No.: 13/220,484

(22) Filed: Aug. 29, 2011

(65) Prior Publication Data

US 2012/0147075 A1 Jun. 14, 2012

(30) Foreign Application Priority Data

Dec. 13, 2010 (JP) ..... 2010-276838

(51) Int. Cl.
*B41J 29/38* (2006.01)
*B41J 2/045* (2006.01)

(52) U.S. Cl.
USPC ..... 347/9; 347/69

(58) Field of Classification Search
None
See application file for complete search history.

(56) References Cited

U.S. PATENT DOCUMENTS

| | | | | |
|---|---|---|---|---|
| 5,245,244 | A * | 9/1993 | Takahashi et al. | 310/328 |
| 6,814,419 | B2 * | 11/2004 | Yazdy | 347/12 |
| 6,841,920 | B2 | 1/2005 | Takamura et al. | |
| 7,992,964 | B2 * | 8/2011 | Yanagisawa et al. | 347/47 |
| 2010/0007704 | A1 | 1/2010 | Nitta | |
| 2012/0176430 | A1 * | 7/2012 | Nitta et al. | 347/9 |

FOREIGN PATENT DOCUMENTS

| | | |
|---|---|---|
| JP | 2003-246064 | 9/2003 |
| JP | 2004-148604 | 5/2004 |
| JP | 2009-262543 | 11/2009 |

OTHER PUBLICATIONS

Office Action mailed Oct. 22, 2013 in corresponding Japanese Patent Application No. 2010-276838 (with English translation).

* cited by examiner

*Primary Examiner* — Geoffrey Mruk
(74) *Attorney, Agent, or Firm* — Patterson & Sheridan, L.L.P.

(57) ABSTRACT

According to one embodiment, a direct current voltage which has positive and negative potentials relative to a ground potential interposed therebetween is used as a drive voltage for electric charging/discharging to/from an actuator.

8 Claims, 14 Drawing Sheets

LIQUID EJECTION APPARATUS, DRIVE CIRCUIT THEREOF, AND DRIVE METHOD THEREOF

CROSS-REFERENCE TO RELATED APPLICATIONS

This application is based upon and claims the benefit of priority from Japanese Patent Application No.2010-276838, filed on Dec. 13, 2010; the entire contents of which are incorporated herein by reference.

FIELD

Embodiments described herein relate generally to a liquid ejection apparatus, a drive circuit thereof, and a drive method thereof.

BACKGROUND

A liquid ejection apparatus used in an inkjet printer or, namely, an inkjet head includes: a plurality of pressure chambers to which ink as a liquid is introduced; a plurality of electrostatic capacitive loads such as piezoelectric elements which apply pressures for introducing and ejecting the ink; a plurality of electrodes for applying a drive voltage to the piezoelectric elements; a nozzle plate (also referred to as an orifice plate) comprising nozzles for ejecting the ink, at positions respectively corresponding to the pressure chambers; and a mask plate which protects the nozzle plate. Electrostatic capacitive actuators are respectively constructed by the piezoelectric elements and the electrodes. The mask plate is grounded in order to release static electricity generated by contact with recording media.

Since the mask plate is connected to the ground, a great potential difference appears between the electrodes in the pressure chambers and the mask plate. When aqueous ink is used, the potential difference causes electrolysis of moisture in the ink in the pressure chambers, and produces foreign substances such as air bubbles and condensate in the ink or dissolves or corrodes the electrodes. When foreign substances are produced, flow of ink from the pressure chambers to the nozzles is hindered, and at worst, the nozzles clog due to the foreign substances and disable ejection of ink. Further, the potential difference may change the quality of the ink.

DETAILED DESCRIPTION

In general, according to one embodiment, a liquid ejection apparatus includes: a pressure chamber; an actuator which is operated by electric charging/discharging and applies pressures for introducing and ejecting a liquid to the pressure chamber; and a drive circuit which outputs a direct current voltage having positive and negative potentials relative to a ground potential interposed therebetween, as a drive voltage for charging/discharging to/from the actuator.

Description of First Embodiment

Figure 1:
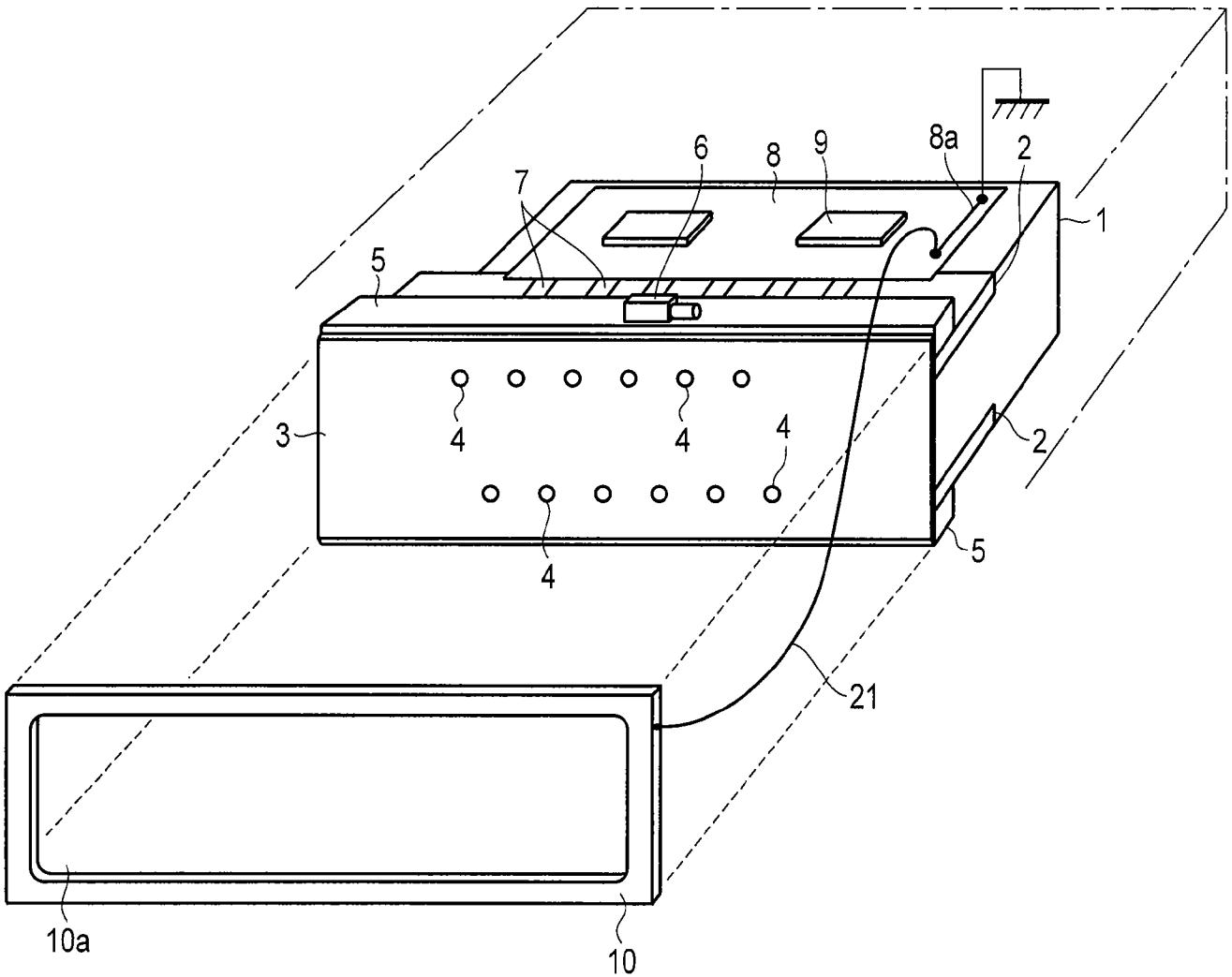
FIG. 1 shows an overall configuration of an inkjet head according to embodiments.
Figure 2:
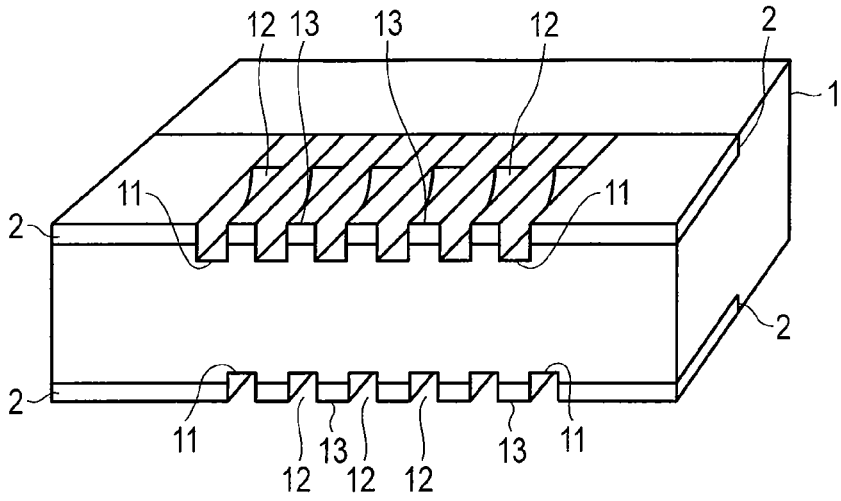
FIG. 2 shows a main part of FIG. 1.

Hereinafter, the first embodiment will be described with reference to the drawings. FIG. 1 shows an overall configuration of an inkjet head as a liquid ejection apparatus, and FIG. 2 shows a state in which a nozzle plate of the inkjet head is detached.

A plate-type piezoelectric material 2 is provided, embedded in an end edge of an upper surface of a base 1 made of a piezoelectric material. Side surfaces of the piezoelectric material 2 respectively form the same planes as side surfaces of the base 1. Another plate-type piezoelectric material 2 is provided, embedded in an end edge of a lower surface of the base 1. Side surfaces of the latter piezoelectric material 2 also respectively form the same planes as the side surfaces of the base 1.

A nozzle plate (also referred to as an orifice plate) 3 is provided on end surfaces of the piezoelectric materials 2 and a side surface of the base 1. The nozzle plate 3 comprises a plurality of nozzles 4 for ejecting ink (or for ejecting a liquid), which are arranged along the piezoelectric material 2 in the upper surface side of the base 1, and a plurality of nozzles 4 for ejecting ink, which are arranged along the piezoelectric material 2 in the lower surface side of the base 1.

A plurality of notches 11 are formed at positions corresponding to the nozzles 4 in a part where one side surface of the piezoelectric material 2 in the upper surface side of the base 1 and one side surface of the base 1 overlap each other. From the notches 11 to the upper surface of the piezoelectric material 2, groove-type pressure chambers 12 are formed. Pairs of piezoelectric elements (electrostatic capacitive loads) each are formed by parts of the piezoelectric material 2 and the base 1 which exist between one another of the pressure chambers 12. In each pair of piezoelectric elements, the piezoelectric elements overlap each other, with polarization directions opposed to each other, in a direction perpendicular to an arranged direction of the pressure chambers 12. An electrostatic capacitive actuator 13 which applies pressures for introducing (liquid introduction) and ejecting (liquid ejection) ink is constructed by each pair of piezoelectric elements.

The electrostatic capacitive actuators 13 form walls which partition the pressure chambers 12 from one another.

Figure 3:
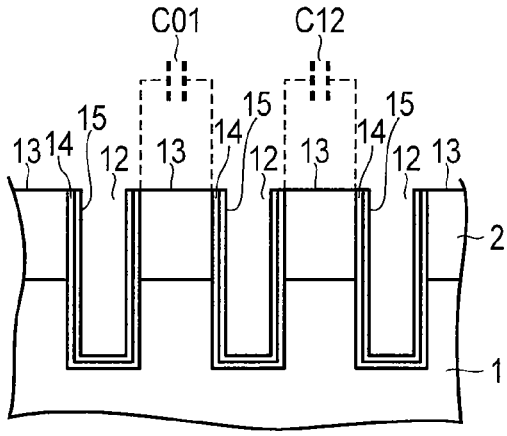
FIG. 3 is an enlarged view showing pressure chambers and periphery thereof.

As shown in FIG. 3, electrodes 14 for applying a drive voltage to the electrostatic capacitive actuators 13 are respectively provided on inner peripheral surfaces of the pressure chambers 12, i.e., on side surface parts of the electrostatic capacitive actuators 13 and on bottom parts of the pressure chambers 12. Further, a surface of each electrode 14 is covered with an insulating film 15 in order to prevent the electrodes 14 and ink (liquid) in the pressure chambers 12 from making contact with each other.

Also in the lower surface side of the base 1, a plurality of pressure chambers 12, a plurality of electrostatic capacitive actuators 13, a plurality of electrodes 14, and an insulating film 15 are provided.

The pressure chambers 12 in the upper surface side of the base 1 are closed with a cover 5. An ink inlet port 6 is provided above the cover 5, and ink (liquid) which flows into the ink inlet port 6 is guided to each of the pressure chambers 12. A plurality of conductive members 7 are led respectively from the electrodes 14 in the pressure chambers 12. The conductive members 7 are connected to a circuit board 8. A drive circuit 9 is mounted on the circuit board 8. The drive circuit 9 outputs a drive voltage for each electrostatic capacitive actuator 13.

A mask plate 10 for protection is provided on the periphery of the nozzle plate 3. The mask plate 10 is made of metal and comprises an opening 10*a* inside. In FIG. 1, the mask plate 10 is separate from the nozzle plate 3. In actuality, however, the mask plate 10 is in surface contact with the mask plate 10. An end of a lead (earth line) 21 is connected to the mask plate 10, and the other end of the lead 21 is connected to a ground line (conductive pattern) 8*a* on the circuit board 8.

The electrostatic capacitive actuators 13 respectively have electrostatic capacities C01, C12, . . . In the following, electrostatic capacitive actuators 13 each of which has the electrostatic capacity C01 is referred to as an actuator C01, for easy understanding of descriptions. Each electrostatic capacitive actuator 13, which has the electrostatic capacity C12, is referred to as an actuator C12. As the actuators C01, C12, . . . are driven to electrically charge and discharge, the actuators C01, C12, . . . repeatedly deform and recover as shown in FIGS. 3, 4, 5, and 6.

Figure 4:
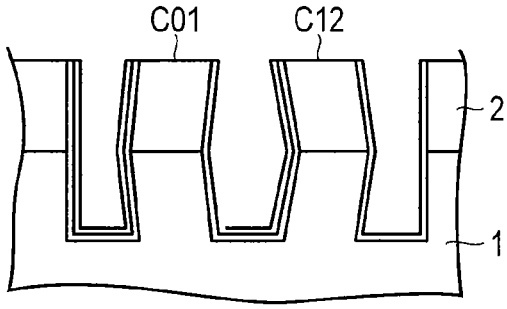
FIG. 4 is shows a state in which one of the pressure chambers shown in FIG. 3 expands.
Figure 5:
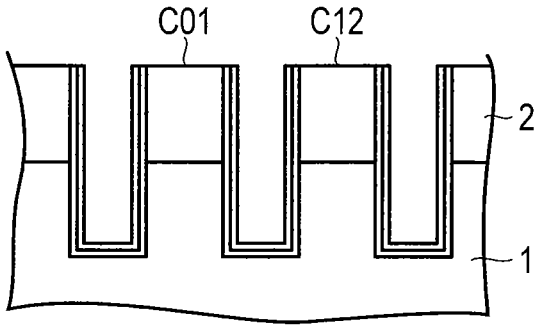
FIG. 5 shows a state in which a pressure chamber which expanded as shown in FIG. 4 recovers to a stationary state.
Figure 6:
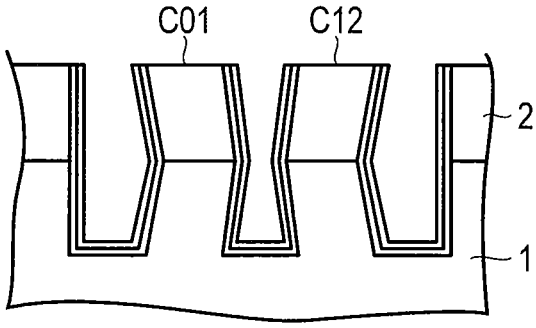
FIG. 6 shows a state in which a pressure chamber which has recovered the stationary state contracts.

FIG. 3 shows a stationary state in which none of the actuators C01 and C12 are applied with a drive voltage. When the actuators C01 and C12 in two sides of a pressure chamber 12 are respectively charged in opposite directions to each other, the actuators C01 and C12 deform in directions to move away from each other, as shown in FIG. 4. In accordance with the deformation, the pressure chamber 12 expands and ink is introduced into the pressure chamber 12. When the actuators C01 and C12 electrically discharge thereafter, the actuators C01 and C12 recover the stationary state, as shown in FIG. 5. In accordance with the recovery, the pressure inside the pressure chamber 12 is increased, and the ink is thereby ejected through a nozzle 4 from inside of the pressure chamber 12. Thereafter, the actuators C01 and C12 are respectively charged in directions opposite to the foregoing directions as shown in FIG. 4. Accordingly, the actuators C01 and C12 deform in directions to be close to each other as shown in FIG. 6. Further, when the actuators C01 and C12 electrically discharge, the actuators C01 and C12 recover to the stationary state. The deformation in FIG. 6 and the recovery in FIG. 3 function as damping to suppress vibration caused in the ink inside the pressure chamber 12 by ejection.

Figure 7:
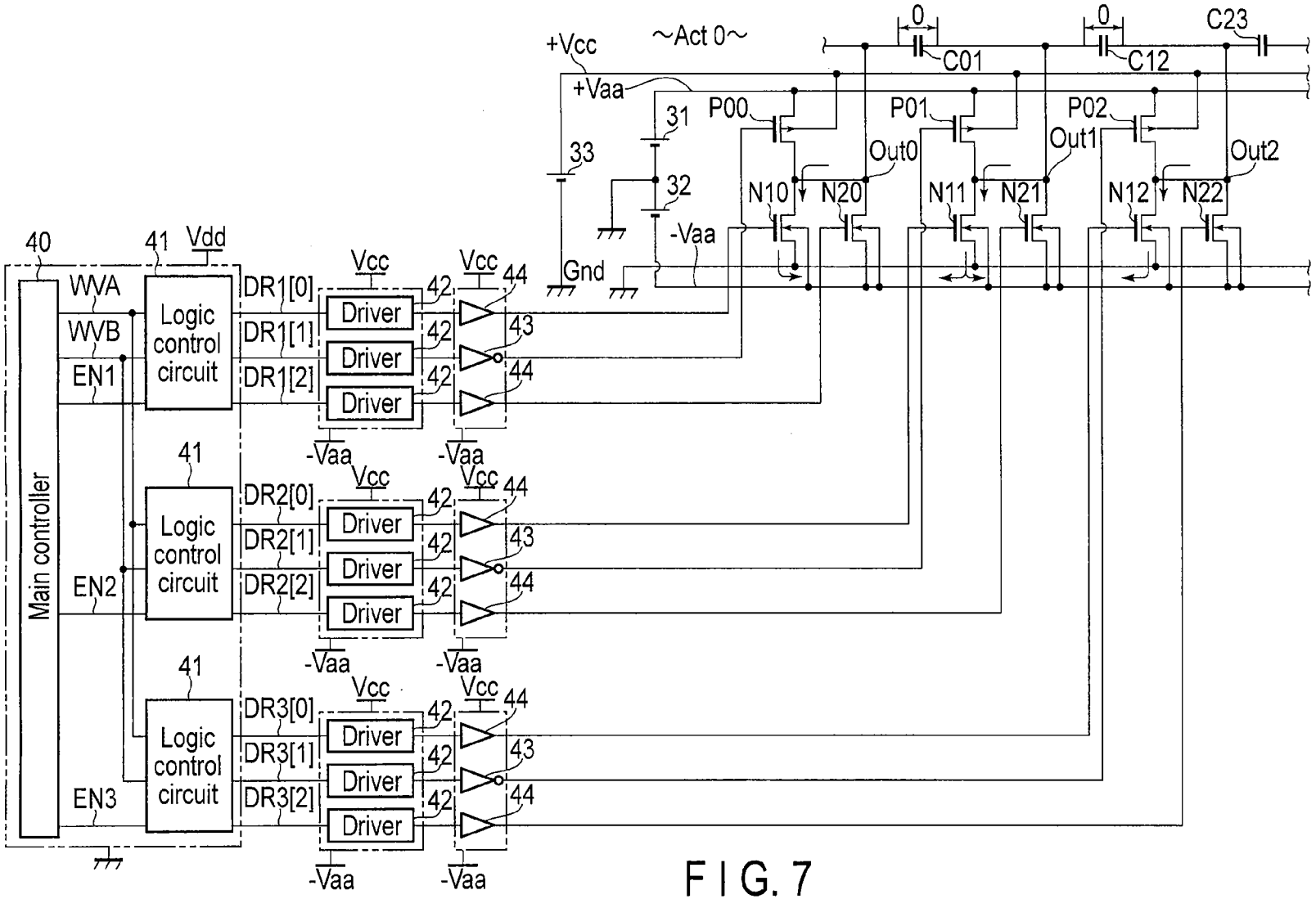
FIG. 7 shows a configuration of a drive circuit in the embodiments and operation in Act 0.

FIG. 7 shows a specific configuration of the drive circuit 9 described above.

A direct-current power supply (first DC power supply) 31 which outputs a direct current voltage Vaa, such as 10 V, and a direct-current power supply (second DC power supply) 32 which also outputs the direct current voltage Vaa are connected in series. An interconnection point between the direct-current power supplies 31 and 32 is grounded. An output voltage ±Vaa (=2·Vaa) from the serial circuit of the direct-current power supplies 31 and 32 is a drive voltage for the actuators described later. The drive voltage ±Vaa has an amplitude (variable width) between positive and negative potentials with a ground potential interposed therebetween and is selected as any value between ±7 V and ±18 V, so as to be compatible with various types of ink.

A negative side of a direct-current power supply (third DC power supply) 33 which outputs a direct current voltage Vcc is grounded. The direct current voltage Vcc functions as a bias voltage to back gates of P-type MOS transistors P00, P01, P02, . . . and also as a drive voltage for drivers 42 and buffers 43 and 44 described later. For example, a value higher than the direct current voltage Vaa is selected as the value of the direct current voltage Vcc. That is, a value such as 24 V, which is evaluated by calculating avoidance of latch-up due to overshooting of an electrode potential for the drive voltage ±Vaa selectively set to any value between ±7 V and ±18 V, is selected as a proper value for the direct current voltage Vcc.

A serial circuit, which is constructed by a source-drain connection of a first semiconductor device (first switch) such as a P-type MOS transistor P00 and a drain-source connection of a second semiconductor device (second switch) such as an N-type MOS transistor N10, is connected between a positive side (+Vaa) of the direct-current power supply 31 and the ground (±0). A drain-source connection of a third semiconductor device (third switch) such as an N-type MOS transistor N20 is connected between an interconnection point between P-type MOS transistor P00 and N-type MOS transistor N10 and a negative side (−Vaa) of the direct-current power supply 32.

A back gate of the P-type MOS transistor P00 is connected to a positive side (+Vcc) of the direct-current power supply 33. Back gates of the N-type MOS transistors N10 and N20 are connected to a negative side (−Vaa) of the direct-current power supply 33. The interconnection point between the P-type MOS transistor P00 and N-type MOS transistor N10 functions as an output terminal Out0. One end of an actuator C01 is connected to the output terminal Out0.

A switch circuit (first switch circuit) for selectively forming a conduction path for electric charging/discharging for one end of the actuator C01 is constructed by the P-type MOS transistor P00 and N-type MOS transistors N10 and N20. When the P-type MOS transistor P00 turns on and the N-type MOS transistors N10 and N20 turn off, the potential then goes to +Vaa at the one end of the actuator C01. When the P-type MOS transistor P00 and N-type MOS transistor N20 turn off and the N-type MOS transistor N10 turns on, the potential then goes to the ground potential (zero) at the one end of the actuator C01. When the P-type MOS transistor P00 and N-type MOS transistor N10 turn off and the N-type MOS transistor N20 turns on, the potential goes to −Vaa at the one end of the actuator C01.

A serial circuit, which is constructed by a source-drain connection of a fourth semiconductor device (fourth switch) such as a P-type MOS transistor P01 and by a drain-source connection of an N-type MOS transistor (fifth switch) N11, is connected between the positive side (+Vaa) of the direct-current power supply 31 and the ground (±0). A drain-source connection of a sixth semiconductor device (sixth switch) such as an N-type MOS transistor N21 is connected between an interconnection point between the P-type MOS transistor P01 and the N-type MOS transistor N11 and the negative side (−Vaa).

A back gate of the P-type MOS transistor P01 is connected to the positive side (+Vcc) of the direct-current power supply 33. Back gates of the N-type MOS transistors N11 and N21 are connected to a negative side (−Vaa) of the direct-current power supply 32. The interconnection point between the P-type MOS transistor P01 and N-type MOS transistor N11 functions as an output terminal Out1. The other end of the actuator C01 is connected to the output terminal Out1.

A switch circuit (second switch circuit) for selectively forming a conduction path for electric charging/discharging for the other end of the actuator C01 is constructed by the P-type MOS transistor P01 and N-type MOS transistors N11 and N21. When the P-type MOS transistor P01 turns on and the N-type MOS transistors N11 and N21 turn off, the potential then goes to +Vaa at the other end of the actuator C01. When the P-type MOS transistor P01 and N-type MOS transistor N21 turn off and the N-type MOS transistor Nil turns on, the potential then goes to the ground potential at the other end of the actuator C01. When the P-type MOS transistor P01 and N-type MOS transistor N11 turn off and the N-type MOS transistor N21 turns on, the potential goes to −Vaa at the other end of the actuator C01.

The P-type MOS transistor P01 functions also as a first semiconductor device for an adjacent actuator C12. The N-type MOS transistors N11 and N21 function also as second and third semiconductor devices for a neighboring actuator C12. That is, the switch circuit constructed by the P-type MOS transistor P01 and N-type MOS transistors N11 and N21 also functions as a switch circuit (first switch circuit) which selectively forms a conductive path for electric charging/discharging for one end of the adjacent actuator C12.

A serial circuit, which is constructed by a source-drain connection of a fourth semiconductor device (fourth switch) such as a P-type MOS transistor P02 and by a drain-source connection of an N-type MOS transistor (fifth switch) N12, is connected between the positive side (+Vaa) of the direct-current power supply 31 and the ground (±0). A drain-source connection of a sixth semiconductor device (sixth switch) such as an N-type MOS transistor N22 is connected between an interconnection point between the P-type MOS transistor P02 and the N-type MOS transistor N12 and the negative side (−Vaa) of the direct-current power supply 31.

A back gate of the P-type MOS transistor P02 is connected to the positive side (+Vcc) of the direct-current power supply 33. Back gates of the N-type MOS transistors N12 and N22 are connected to the negative side (−Vaa) of the direct-current power supply 32. The interconnection point between the P-type MOS transistor P02 and N-type MOS transistor N12 functions as an output terminal Out2. The other end of the actuator C02 is connected to the output terminal Out2.

A switch circuit (second switch circuit) which selectively forms a conductive path for electric charging/discharging for the other end of an actuator C12 is constructed by the P-type MOS transistor P02 and N-type MOS transistors N12 and N22.

The P-type MOS transistor P02 functions also as a first semiconductor device for an adjacent actuator C23. The N-type MOS transistors N12 and N22 function also as second and third semiconductor devices for the adjacent actuator C23. That is, the switch circuit constructed by the P-type MOS transistor P02 and N-type MOS transistors N12 and N22 also functions as a switch circuit (first switch circuit) which selectively forms a conductive path for electric charging/discharging for one end of the adjacent actuator C23.

On the other side, a main controller 40 outputs controls signals WVA and WVB common to the switch circuits described above, and also individual control signals EN1, EN2, EN3, . . . respectively to the switch circuits described above. The main controller 40 and logic control circuit 41 are operated by a direct current voltage Vdd.

Figure 8:
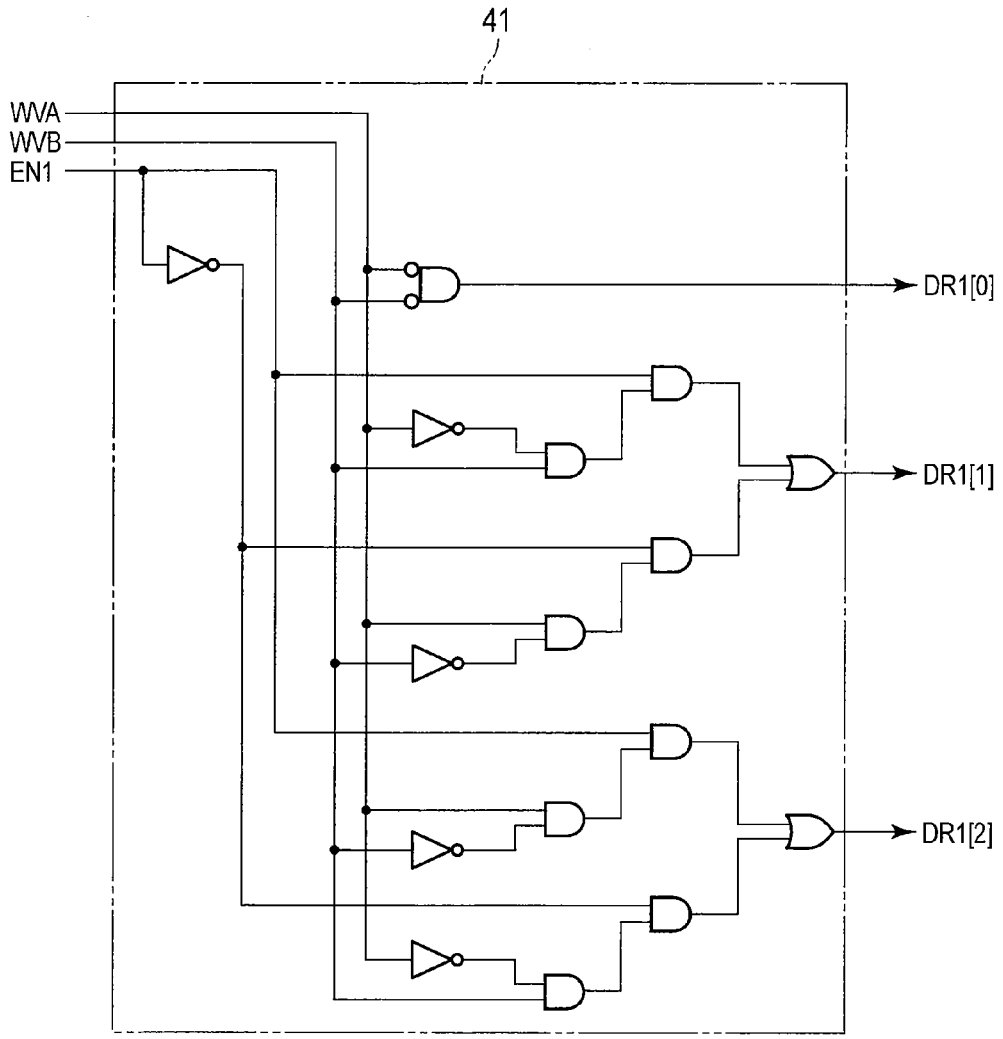
FIG. 8 shows a logic control circuit in the drive circuit according to the first embodiment.

Among logic control circuits 41, a logic control circuit 41 corresponding to the switch circuits for the MOS transistors P00, N10, and N20 comprises a large number of logic control circuits as shown in FIG. 8, and outputs drive control signals DR1[0], DR1[1], and DR1[2] for driving on/off the MOS transistors P00, N10, and N20. A logic control circuit 41 corresponding to the switch circuits for the MOS transistors P01, N11, and N21 also comprises a large number of logic control circuits, and outputs drive control signals DR2[0], DR2[1], and DR2[2]. A logic control circuit 41 corresponding to the switch circuits for the MOS transistors P02, N12, and N22 outputs drive control signals DR3[0], DR3[1], and DR3[2].

Drive control signals which are output from the logic control circuits 41 are supplied respectively through the drivers 42 and buffers 43 and 44 to the gates of the MOS transistors described above.

Operation of the drive circuit 9 configured as described above is shown in FIGS. 7, 9, 10, 11, and 12. Voltage waveforms at respective parts of the drive circuit 9 are shown at Acts 0 to 4 in FIG. 13. The following descriptions will be mainly made of driving of the actuators C01 and C12 only, and avoid redundant explanation relating to operation of all the actuators.

In Act 0, as shown in FIG. 7, the MOS transistors N10, N11, and N12 turn on, and a closed circuit (discharge path) for the actuators C01 and C12 is formed through the ground. Output terminals Out0, Out1, and Out2 are at the ground potential. At this time, the actuators C01 and C12 are in the stationary state shown in FIG. 3.

Figure 9:
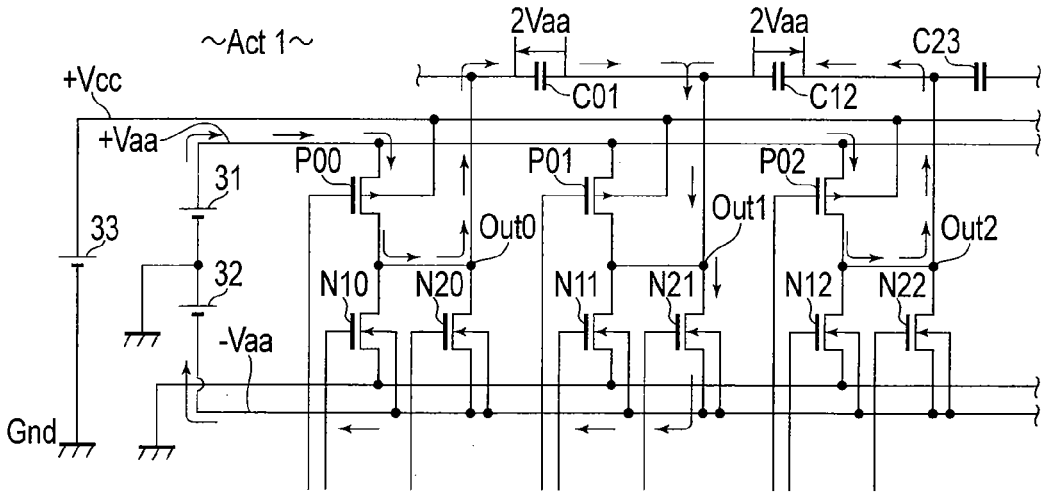
FIG. 9 shows Act 1 according to the first embodiment.

In Act 1, as shown in FIG. 9, the MOS transistors P00, P02, and N21 turn on. In this case, at the output terminals Out0 and Out2, the potentials increase from the ground potential to the potential −Vaa. At the output Out1, the potential decreases from the ground potential to −Vaa potential. A voltage ±Vaa (=2·Vaa=20 V) between the output terminal Out0 and Out1 is added to the actuator C12. The voltage ±Vaa between the output terminals Out2 and Out1 is added to the actuator C12. The actuators C01 and C12 each are thereby electrically charged up to the voltage 2·Vaa.

This charging causes the actuators C01 and C12 to deform so as to be away from one another. In accordance with this deformation, a pressure chamber 12 corresponding to a nozzle 4 expands, and ink is introduced into the pressure chamber 12.

Figure 10:
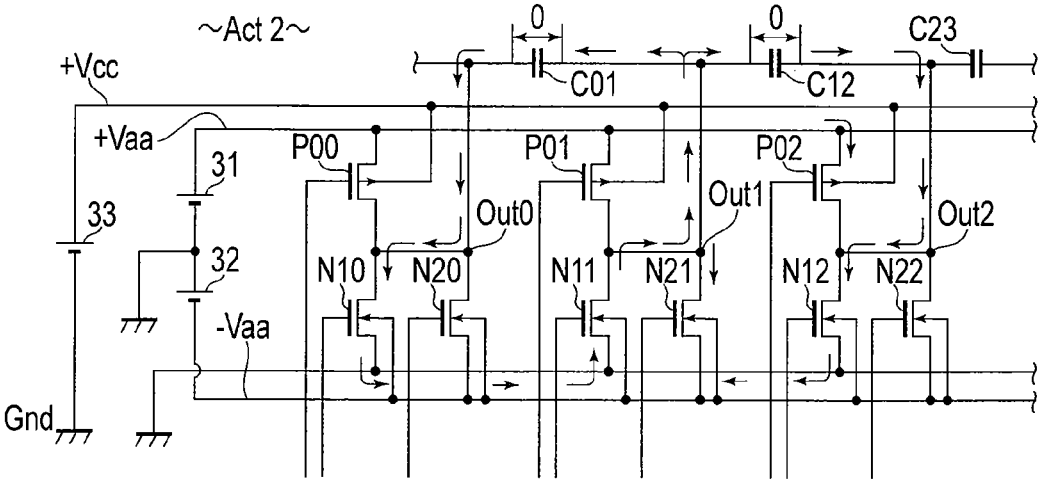
FIG. 10 shows Act 2 according to the first embodiment.

In Act 2, as shown in FIG. 10, the MOS transistors N10, N11, and N12 turn on. At this time, the one end of the actuator C01 charged to the voltage 2·Vaa is electrically conducted to the ground through the output terminal Out0 and MOS transistors N10, and the other end of the actuator C01 is conducted to the ground through the output terminal Out1 and MOS transistors N11. A closed circuit (discharge path) for the actuator C01 is formed through the ground. Through the closed circuit, the voltage 2·Vaa charged to the actuator C01 is discharged. Similarly, the other end of an adjacent actuator C12 is electrically conducted to the ground through the MOS transistors N12. The one end of the actuator C12 is electrically conducted to the ground through the output terminal Out1 and MOS transistors N11, and a closed circuit (discharge path) for the actuator C12 is formed. Through the closed circuit, the voltage 2·Vaa charged to the actuator C12 is discharged.

The discharging causes the actuators C01 and C12 to recover the stationary state, as shown in FIG. 5. In accordance with the recovery, the pressure inside the pressure chamber 12 is increased, and the ink is ejected through a nozzle 4 from inside the pressure chamber 12.

Figure 11:
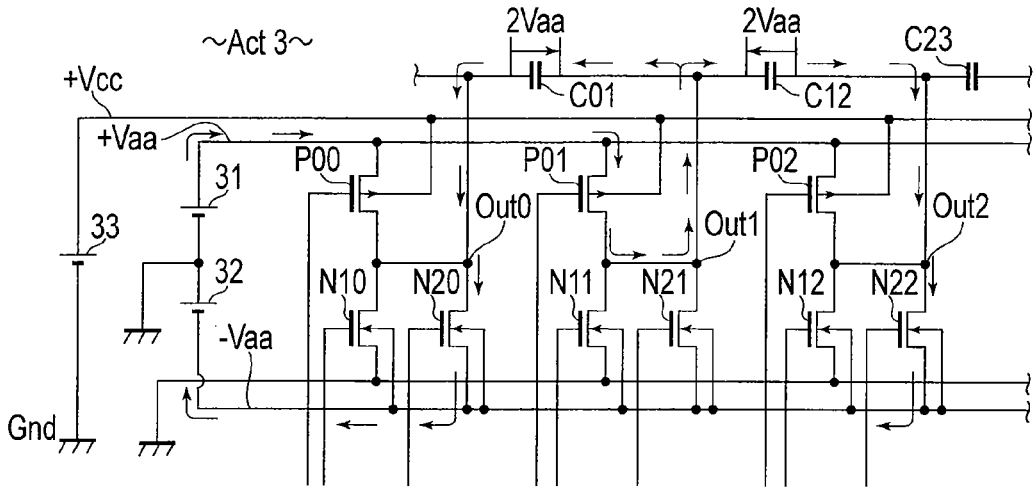
FIG. 11 shows Act 3 according to the first embodiment.

In Act 3, as shown in FIG. 11, the MOS transistors P01, N20, and N22 turn on. At this time, the potential becomes +Vaa at the output terminal Out1, and the potentials become −Vaa at the output terminals Out0 and Out21. A voltage ±Vaa (=2·Vaa=20 V) between the output terminal Out1 and Out0 is added to the actuator C12. A voltage ±Vaa between the output terminals Out1 and Out2 is added to the actuator 12. The actuators C01 and C12 each are thereby electrically charged up to the voltage 2·Vaa.

This charging causes the actuators C01 and C12 to deform in a direction to be close to each other, as shown in FIG. 6.

Figure 12:
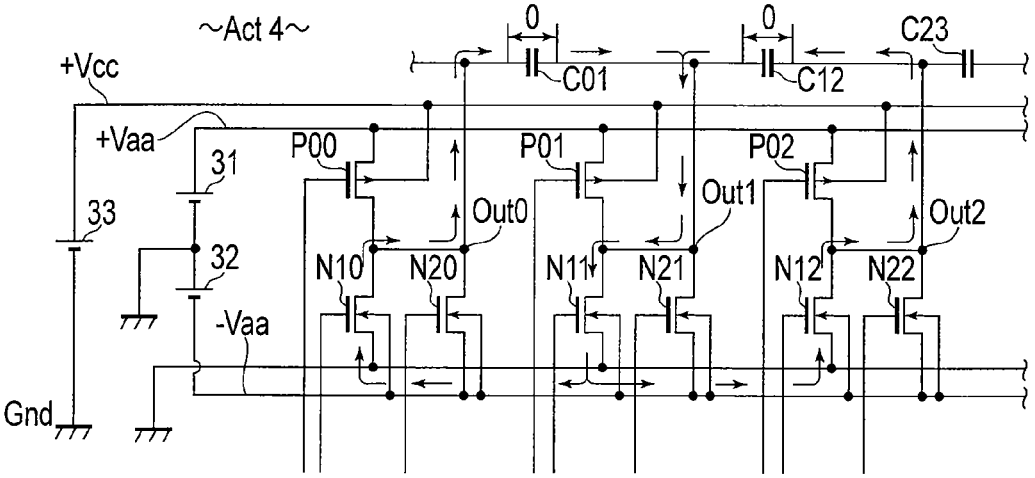
FIG. 12 shows voltage waveforms at individual parts of the drive circuit according to the first embodiment.
Figure 13:
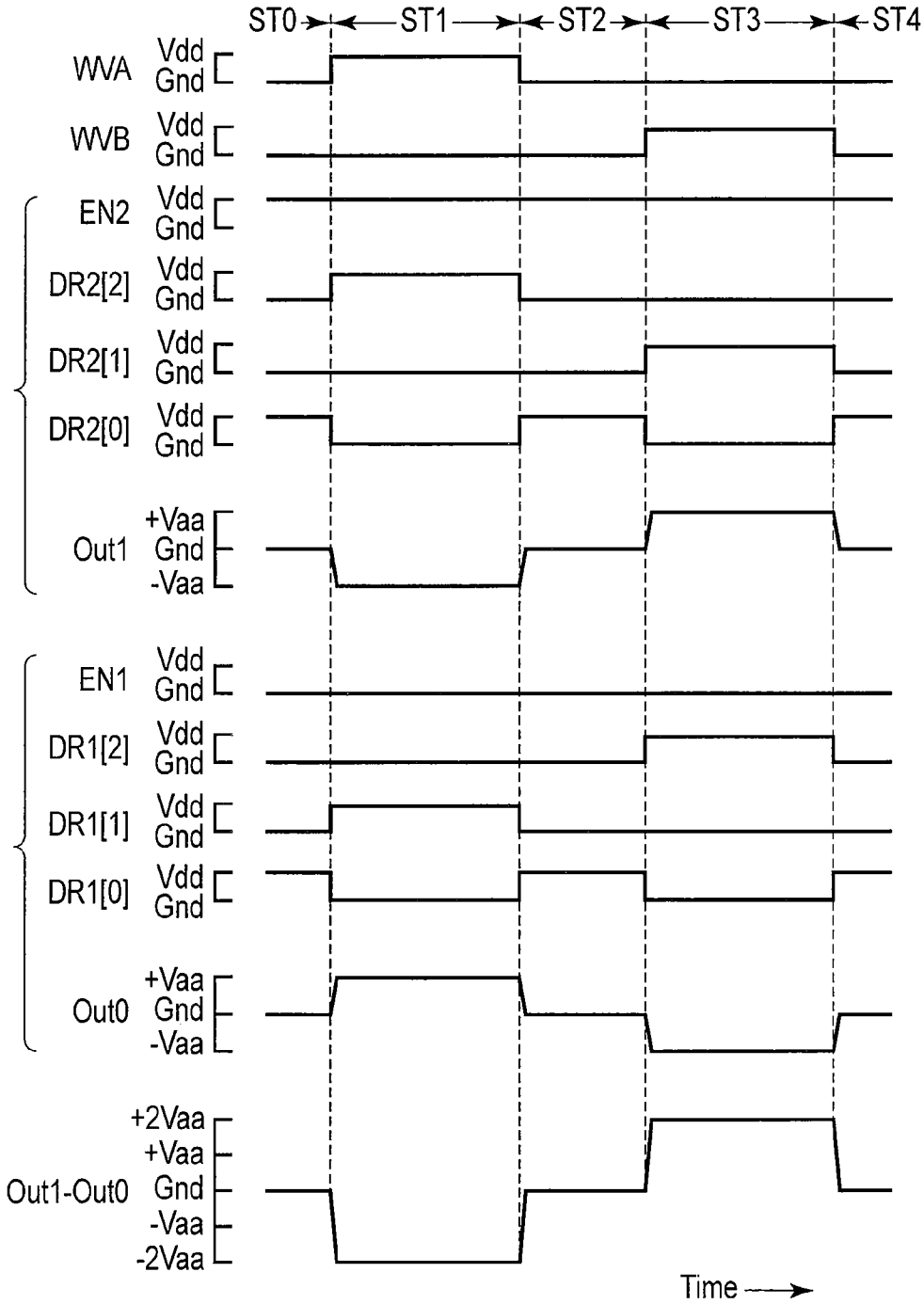
FIG. 13 shows Act 4 according to the first embodiment.
Figure 14:
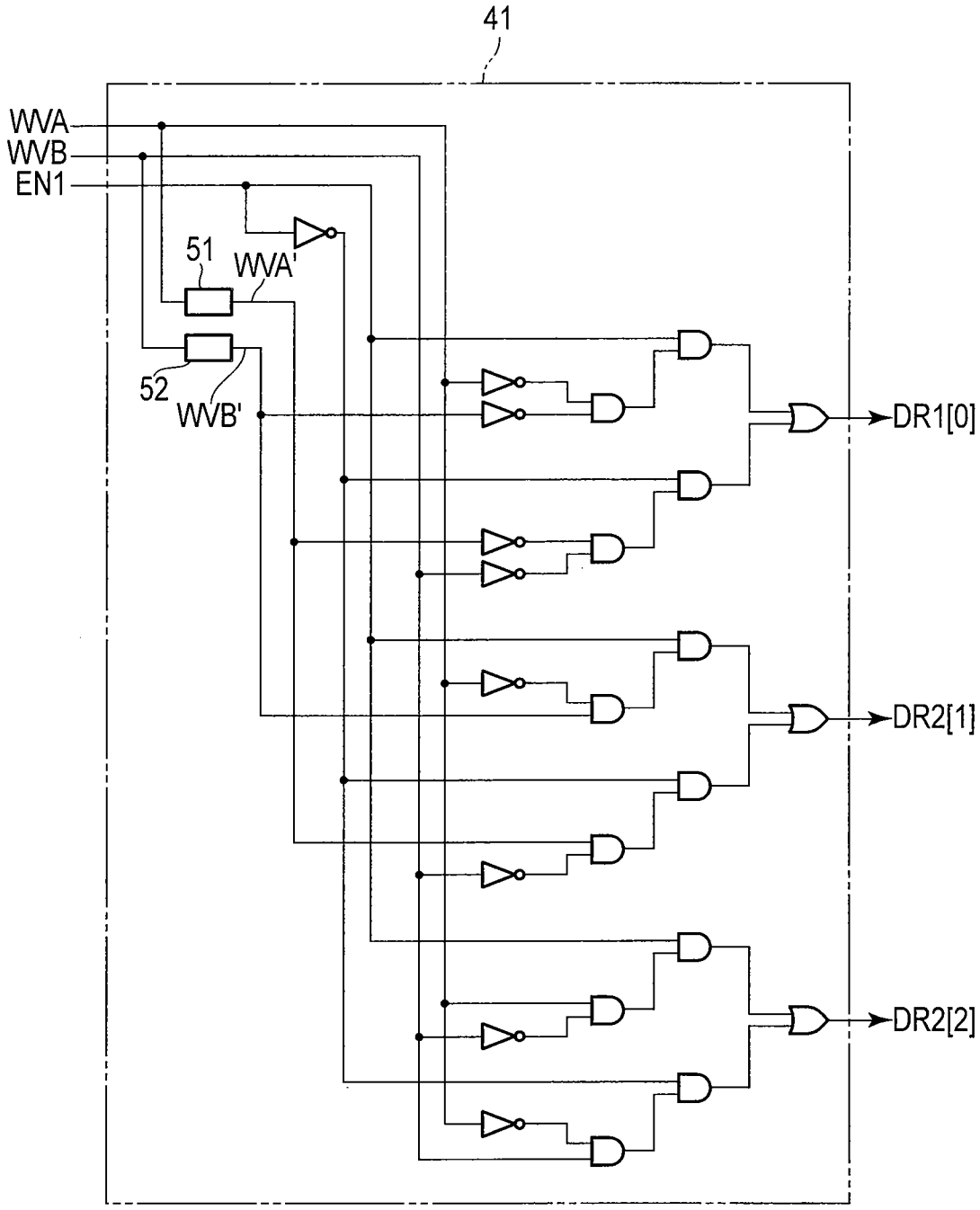
FIG. 14 shows a logic control circuit in a drive circuit according to the second embodiment.

In Act 4, as shown in FIG. 12, the MOS transistors N10, N11, and N12 turn on, as in Act 0. At this time, the other end of the actuator C01 charged to the voltage 2·Vaa is conducted to the ground through the output terminal Out1 and MOS transistor N11. The one end of the actuator C01 is also conducted to the ground through the output terminal Out0 and MOS transistors N10. A closed circuit (discharge path) for the actuator C01 is formed through the ground. Through the closed circuit, the voltage 2·Vaa charged to the actuator C01 is discharged. Similarly, one end of an adjacent actuator C12 is conducted to the ground through the output terminal Out1 and MOS transistor N11, and the other end of the actuator C12 is conducted to the ground through the output terminal Out2 and MOS transistor N12. A closed circuit (discharge path) for the actuator C12 is formed through the ground. The voltage 2·Vaa charged to the actuator C12 is discharged through the closed circuit.

The discharging causes the actuators C01 and C12 to recover the stationary state shown in FIG. 3. The deformation in Act 3 and recovery in Act 4 function as damping to suppress vibration of ink caused in the pressure chamber 12 by ejection.

As described above, the direct current voltage ±Vaa (=2·Vaa=20 V) is supplied as a drive voltage for charging/discharging to/from the actuators C01 and C12. In this manner, a potential difference caused between each electrode 14 and the mask plate 10 can be reduced to half of the drive voltage ±Vaa. That is, a potential difference which is caused when the drive voltage is a positive potential is Vaa (=10 V) which is half the drive voltage ±Vaa (=10 V). A potential difference which is caused when the drive voltage is a negative potential is also Vaa (=10 V) which is half the drive voltage ±Vaa.

Since the potential difference caused between each electrode 14 and the mask plate 10 can be reduced to half the drive voltage ±Vaa, problems of causing electrolysis of moisture in ink in the pressure chambers 12 can be prevented. Since electrolysis can thus be prevented, problems of producing foreign substances such as air bubbles and condensate and of dissolving or corroding the electrodes 14 can be prevented. The potential difference described above which is not large can prevent the ink from changing in quality. Accordingly, the problem of the nozzles 4 clogging with foreign substances can be prevented.

Although only the potential difference is reduced, the amplitude of the drive voltage ±Vaa is not reduced. Therefore, the actuators C01 and C12 can be driven at a sufficient speed. Accordingly, an ink ejection speed can be sufficiently increased, and highly viscous ink can be steadily ejected.

Even if a pin hole should appear in the insulating film 15 formed to cover the electrodes 14, the potential difference between each electrode 14 and the mask plate 10 is not so large, and current leakage from the pin hole can be therefore suppressed to a minimum. This suppression hinders the occurrence of electrolysis as described above and problems associated with the electrolysis. Accordingly, a lifetime of the inkjet head improves.

In addition, an average value of the drive voltage between when ink is ejected and when the ink is waiting (in the stationary state) can be substantially 0 V.

Description of Second Embodiment

Logic control circuits 41 in a drive circuit 9 are added with delay circuits 51 and 52 and a plurality of logic circuits which operate in response to outputs from the delay circuits 51 and 52. Other features of the configuration are the same as those of the first embodiment. Detailed descriptions thereof will be therefore omitted herefrom.

Operation of the drive circuit 9 is shown in FIGS. 7, 15, 16, 17, 18, 19, 20, 21, and 22. Voltage waveforms at respective parts of the drive circuit 9 are shown in Acts 0 to 8 in FIG. 22.

In Act 0, as shown in FIG. 7, the MOS transistors N10, N11, and N12 turn on, and a closed circuit (discharge path) for actuators C01 and C12 is formed through the ground. Output terminals Out0, Out1, and Out2 are at the ground potential. At this time, the actuators C01 and C12 are in a stationary state as shown in FIG. 3.

Figure 15:
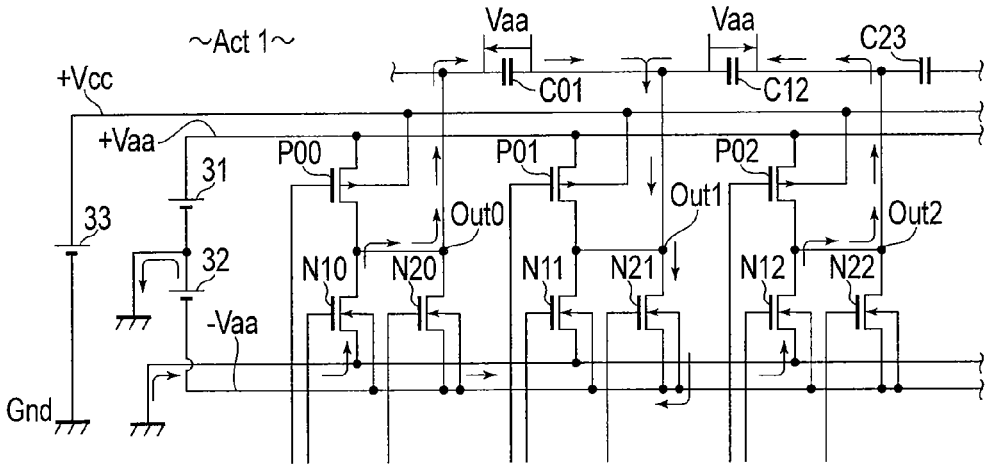
FIG. 15 shows Act 1 according to the second embodiment.

In Act 1, as shown in FIG. 15, the MOS transistors N10, N12, and N21 turn on. At this time, the output terminals Out0 and Out2 maintain the ground potential. At the output terminal Out1, the potential drops from the ground potential to the potential −Vaa. A voltage Vaa between the output terminal Out0 and Out1 is added to the actuator C01. A voltage Vaa between the output terminals Out2 and Out1 is added to the actuator 12. The actuators C01 and C12 each are thereby electrically charged up to the voltage Vaa.

Figure 16:
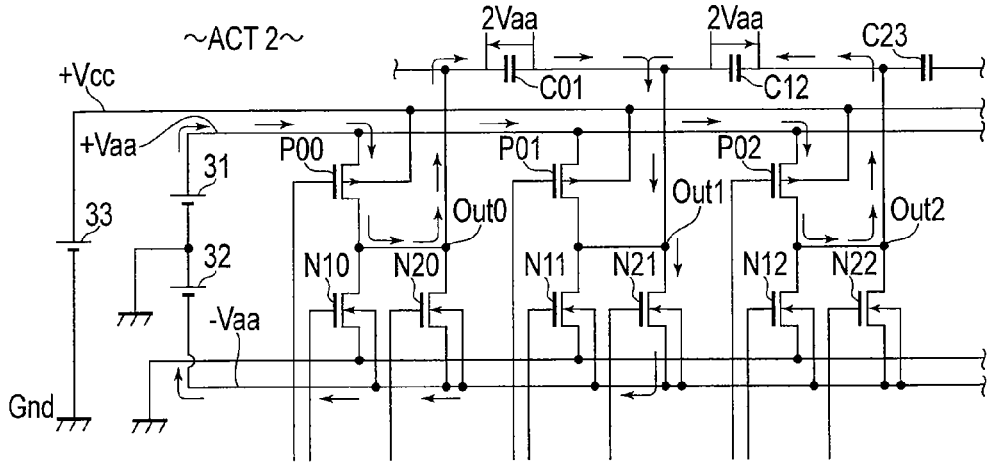
FIG. 16 shows Act 2 according to the second embodiment.

In Act 2, as shown in FIG. 16, the MOS transistors P00, P02, and N21 turn on. At this time, at the output terminals Out0 and Out2, the potentials increase from the ground potential to the potential +Vaa. The output terminal Out1 maintains the potential −Vaa. A voltage ±Vaa (=2·Vaa=20 V) between the output terminals Out0 and Out1 is added to the actuator C01. A voltage ±Vaa (=2·Vaa=20 V) between the output terminals Out2 and Out1 is added to the actuator 12. The actuators C01 and C12 each are thereby continued to be electrically charged, and the actuators C01 and C12 each are electrically charged up to the voltage 2·Vaa.

This charging in Acts 1 and 2 causes the actuators C01 and C12 to deform in a direction to be away from each other, as shown in FIG. 4. This deformation expands the pressure chamber 12 corresponding to a nozzle 4, and introduces ink to the pressure chamber 12.

Figure 17:
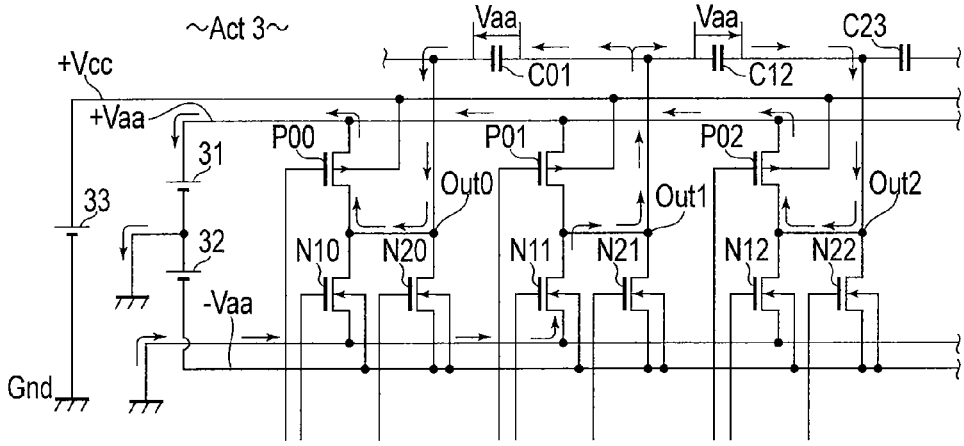
FIG. 17 shows Act 3 according to the second embodiment.

In Act 3, as shown in FIG. 17, the MOS transistors P00, P02, and N11 turn on. At this time, the one end of the actuator C01 charged to the voltage 2·Vaa is conducted to a positive side (+Vaa) of the direct-current power supply 31 through the output terminal Out0 and MOS transistor P00, and the other end of the actuator C01 is conducted to the ground through the output terminal Out1 and MOS transistor N11. Since the voltage 2·Vaa charged to the actuator C01 is higher than the direct current voltage Vaa of the direct-current power supply 31, electric charges charged in the actuator C01 are discharged toward the direct-current power supply 31. Similarly, the other end of the actuator C12 charged to the voltage 2·Vaa is conducted to the positive side (+Vaa) of the direct-current power supply 31 through the output terminal Out2 and MOS transistor P02, and the one end of the actuator C12 is conducted to the ground through the output terminal Out1 and MOS transistors N11. Since the voltage 2·Vaa charged to the actuator C12 is higher than the direct current voltage Vaa of the direct-current power supply 31, electric charges charged in the actuator C12 are discharged toward the direct-current power supply 31.

In accordance with the discharging as described above, the voltage charged to each of the actuators C01 and C12 decreases from 2·Vaa to Vaa.

Figure 18:
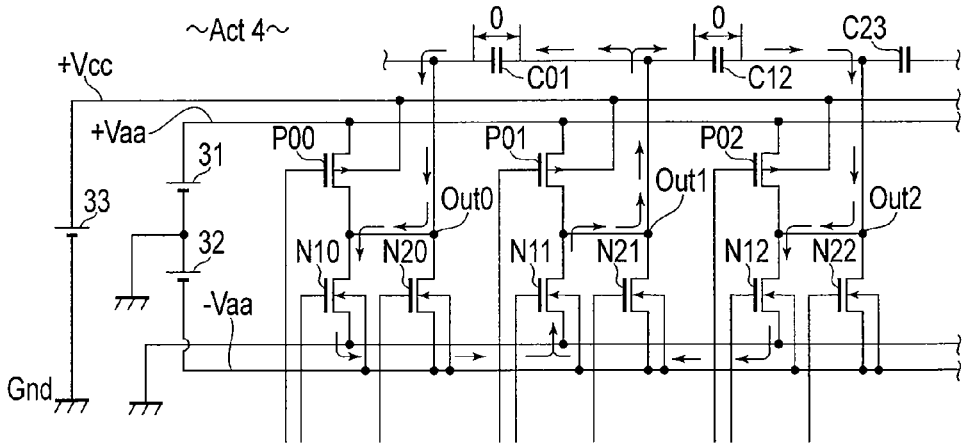
FIG. 18 shows Act 4 according to the second embodiment.

In Act 4, as shown in FIG. 18, the MOS transistors N10, N11, and N12 turn on. At this time, the one and other ends of the actuator C01 in which the charged voltage Vaa remains are conducted to the ground, and a closed circuit (discharge path) for the actuator C01 is formed through the ground. This closed circuit causes the actuator C01 to continue discharging. At the same time, the one and other ends of the actuator C12 in which the charged voltage Vaa remains are conducted to the ground, and a closed circuit (discharge path) for the actuator C12 is formed through the ground. This closed circuit causes the actuator C12 to continue discharging. Continuation of discharging as described causes voltages of the actuators C01 and C12 to change from Vaa to zero.

By the discharging in Acts 3 and 4, the actuators C01 and C12 recover the stationary state, as shown in FIG. 5. In accordance with the recovery, the pressure inside the pressure chamber 12 is increased, and ink is ejected through the nozzle 4 from inside of the pressure chamber 12.

Figure 19:
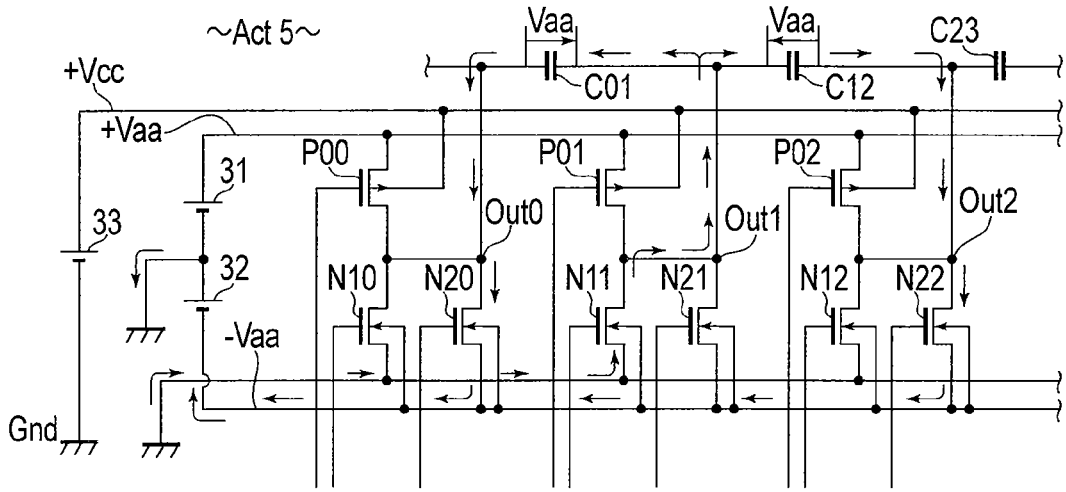
FIG. 19 shows Act 5 according to the second embodiment.

In Act 5, as shown in FIG. 19, the MOS transistors N20, N11, and N22 turn on. At this time, at the output terminal Out1, the potential becomes the ground potential, and at the output terminals Out0 and Out2, the potentials become the potential −Vaa. A voltage between the output terminals Out1 and Out0 is added to the actuator C01. A voltage between the output terminals Out1 and Out2 is added to the actuator 12. The actuators C01 and C12 each are thereby electrically charged up to the voltage Vaa.

Figure 20:
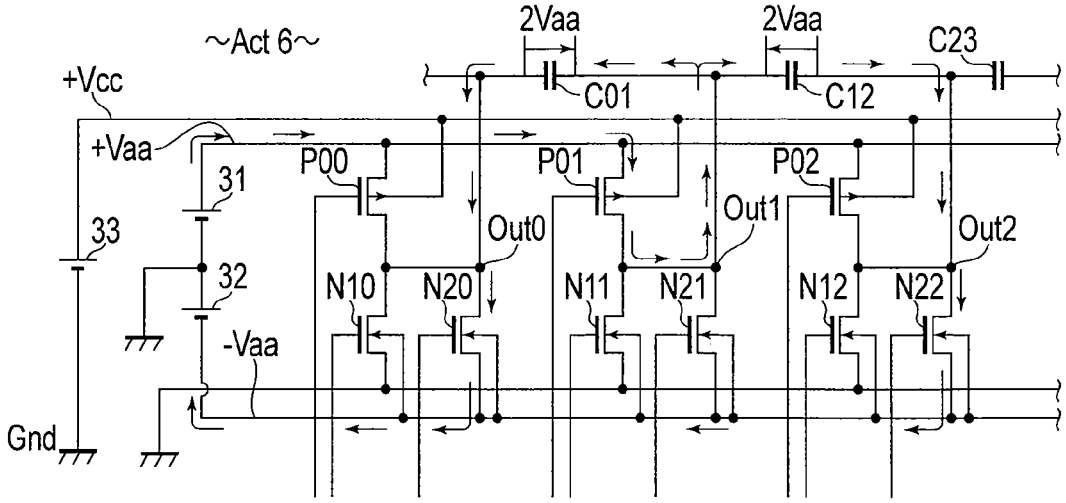
FIG. 20 shows Act 6 according to the second embodiment.

In Act 6, as shown in FIG. 20, the MOS transistors P01, N20, and N22 turn on. At this time, at the output terminal Out1, the potential increases to +Vaa from the ground potential. The output terminals Out0 and Out2 maintain the potential −Vaa. A voltage 2·Vaa between the output terminals Out1 and Out0 is added to the actuator C01. A voltage 2·Vaa between the output terminals Out1 and Out2 is added to the actuator 12. The actuators C01 and C12 each thereby continue being charged, and are electrically charged up to the voltage 2·Vaa.

The charging in Acts 5 and 6 causes the actuators C01 and C12 to deform in a direction to be close to each other, as shown in FIG. 6.

Figure 21:
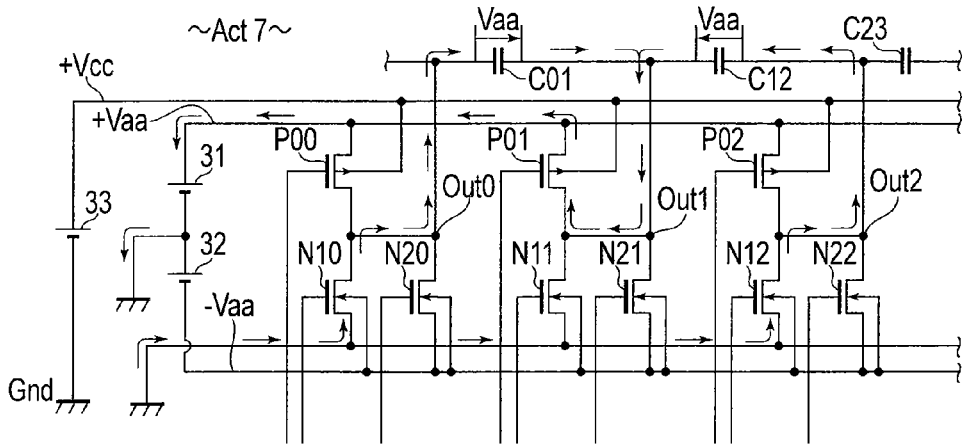
FIG. 21 shows Act 7 according to the second embodiment.

In Act 7, as shown in FIG. 21, the MOS transistors P01, N10, and N12 turn on. At this time, the other end of the actuator C01 charged to the voltage 2·Vaa is conducted to the positive side (+Vaa) of the direct-current power supply 31 through the output terminal Out1 and MOS transistors P01, and the one end of the actuator C01 is conducted to the ground through the output terminal Out0 and MOS transistor N10. Charges charged in the actuator C01 are thereby discharged toward the direct-current power supply 31. Similarly, the one end of the actuator C12 charged to the voltage 2·Vaa is conducted to the positive side (+Vaa) of the direct-current power supply 31 through the output terminal Out1 and MOS transistors P01, and the other end of the actuator C12 is conducted to the ground through the output terminal Out2 and MOS transistor N12. Charges charged in the actuator C12 are thereby discharged toward the direct-current power supply 31. In accordance with the discharging as described above, voltages of the actuators C01 and C12 decrease from 2·Vaa to Vaa.

Figure 22:
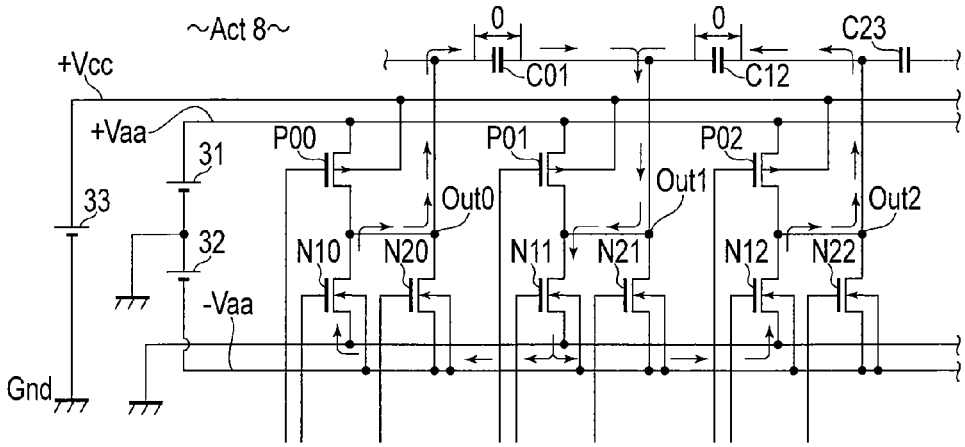
FIG. 22 shows Act 8 according to the second embodiment.
Figure 23:
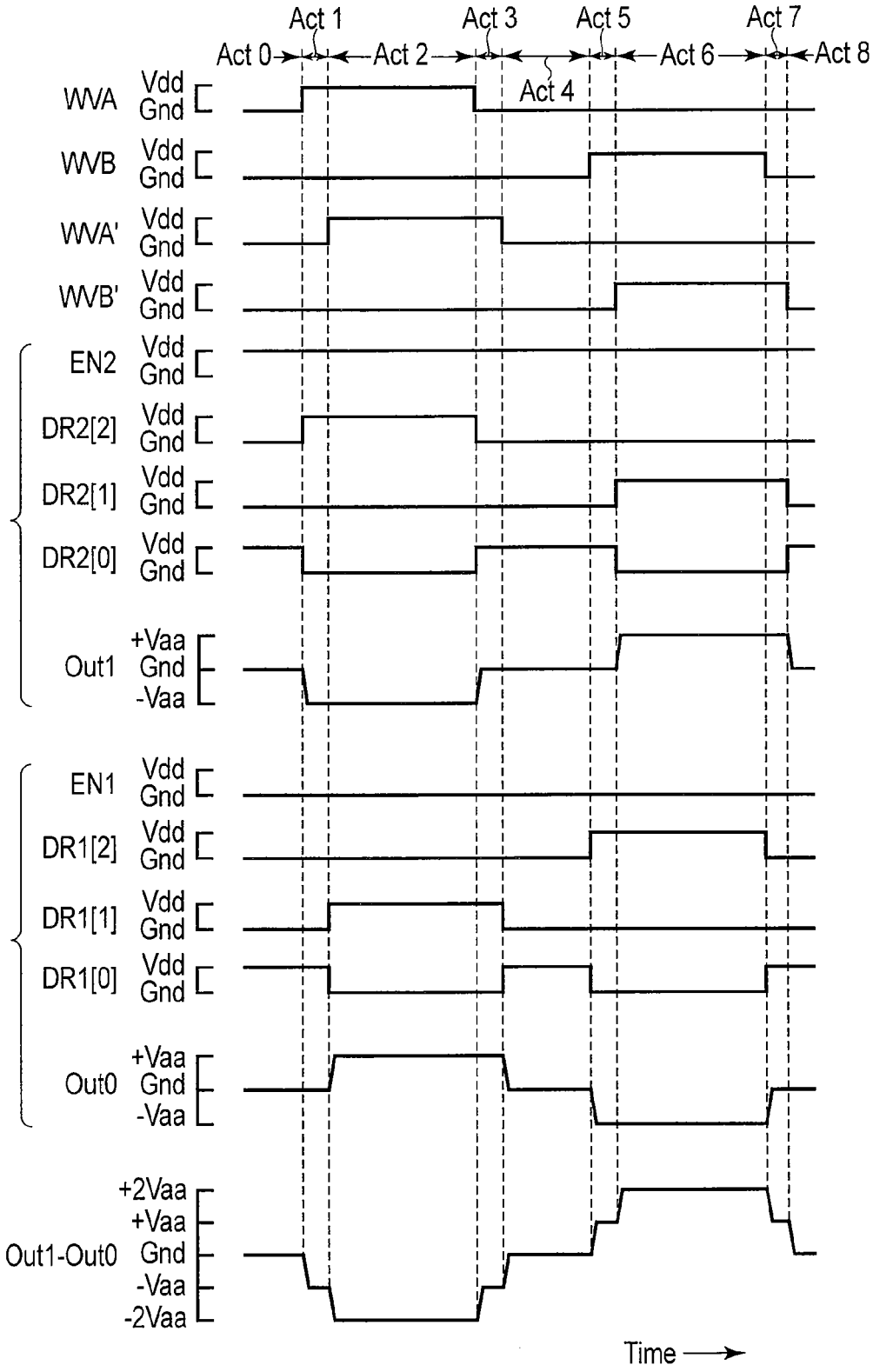
FIG. 23 shows waveforms at individual parts of the drive circuit according to the second embodiment.

In Act 8, as shown in FIG. 22, the MOS transistors N10, N11, and N12 turn on. In this case, the other end of the actuator C01 in which the charged voltage Vaa remains is conducted to the ground through the output terminal Out1 and MOS transistor N11, and the one end of the actuator C01 is conducted to the ground through the output terminal Out0 and MOS transistors N10. A closed circuit (discharge path) for the actuator C01 is thereby formed through the ground. The actuator C01 continues discharging through the closed circuit. Similarly, the one end of an adjacent actuator C12 is conducted to the ground through the output terminal Out1 and MOS transistor N11, and the other end of the actuator C12 is conducted to the ground through the output terminal Out2 and MOS transistors N12. A closed circuit (discharge path) for the actuator C12 is thereby formed through the ground. The actuator C12 continues discharging through the closed circuit. Continuation of discharging as described above causes voltages of the actuators C01 and C12 to change from Vaa to zero.

The discharging in Acts 7 and 8 causes the actuators C01 and C12 to recover the stationary state as shown in FIG. 3.

The deformation in Acts 5 and 6 and recovery in Acts 7 and 8 as described above function as damping to suppress vibration which is caused in the ink in the pressure chamber 12 by ejection.

As described above, a direct current voltage ±Vaa (=2·Vaa=20 V) which has a positive potential +Vaa and a negative potential −Vaa relative to a ground potential interposed therebetween is supplied as a drive voltage for electric charging/discharging to/from the actuators C01 and C12. In this manner, the same effects as in the first embodiment can be achieved.

Particularly in the second embodiment, charging is performed in two steps respectively in Acts 1 and 2, and discharging is performed also in two steps respectively in Acts 3 and 4. Therefore, current consumption decreases so that power consumption is reduced. Further, charging is performed in two steps respectively in Acts 5 and 6, and discharging is performed also in two steps in Acts 7 and 8. Therefore, also in these Acts, current consumption decreases so that power consumption is reduced.

The embodiments described above each employ MOS transistors as a plurality of semiconductor devices. However, the semiconductor devices are not limited to MOS transistors but other devices may be used insofar as the devices have the same functions as described above.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid ejection apparatus comprising:

a plurality of pressure chambers;

an actuator disposed between the pressure chambers and which is operated by electric charging/discharging to thereby apply pressures for introducing a liquid into the pressure chambers and ejecting a liquid from the pressure chambers, to the pressure chambers;

a drive circuit which outputs a direct current drive voltage having positive and negative potentials relative to a ground potential, causing the actuator to electrically charge/discharge;

a first electrode which applies the positive potential of the direct current drive voltage to one end of the actuator; and a second electrode which applies the negative potential of the direct current drive voltage to the other end of the actuator.

2. The apparatus of claim 1, wherein the actuator is made of a pair of piezoelectric elements with polarization directions opposed to each other, and the pair of piezoelectric elements form a wall partitioning the plurality of pressure chambers from one another.

3. The apparatus of claim 2, wherein the pair of piezoelectric elements is disposed along a direction that is perpendicular to an arrangement direction of the plurality of pressure chambers.

4. The apparatus of claim 1, further comprising:

an insulating film which covers a surface of each of the electrodes, so as to prevent the electrodes from making contact with the liquid in each of the pressure chambers.

5. The apparatus of claim 1, further comprising:

a nozzle plate which comprises a plurality of nozzles for ejecting the liquid, each nozzle disposed at a position corresponding to one of the pressure chambers.

6. The apparatus of claim 5, further comprising:

a mask plate which is provided on the nozzle plate and is grounded.

7. The apparatus of claim 1, wherein the drive circuit comprises:

first and second direct-current power supplies which are connected in series to each other and have an interconnection point grounded;

a first switch circuit which comprises a serial circuit and a third switch, the serial circuit connecting first and second switches between a positive side of the first direct-current power supply and a ground, and the third switch connected between an interconnection point between the first and second switches and a negative side of the second direct-current power supply, thereby to selectively form a conduction path for electric charging/discharging to/from the one end of the actuator; and a second switch circuit which comprises a serial circuit and a sixth switch, the serial circuit connecting fourth and fifth switches between the positive side of the first direct-current power supply and the ground, and the sixth switch connected between an interconnection point between the fourth and fifth switches and the negative side of the second direct-current power supply, thereby to selectively form a conduction path for electric charging/discharging to/from the other end of the actuator.

8. The apparatus of claim 1, wherein the drive circuit comprises:

first and second direct-current power supplies which are connected in series to each other and have an interconnection point grounded;

a third direct-current power supply with a negative side thereof grounded;

a first switch circuit which comprises a serial circuit and a third semiconductor device, the serial circuit connecting first and second semiconductor devices between a positive side of the first direct current power supply and a ground, the third semiconductor device connected between an interconnection point between the first and second semiconductor devices and a negative side of the second direct-current power supply, a back gate of the first semiconductor device connected to a positive side of the third direct-current power supply, and back gates of the second and third semiconductor devices connected to a negative side of the second direct-current power supply, thereby to selectively form a conduction path for electric charging/discharging to/from the one end of the actuator; and a second switch circuit which comprises a serial circuit and a sixth semiconductor device, the serial circuit connecting fourth and fifth semiconductor devices between the positive side of the first direct-current power supply and the ground, the sixth semiconductor device connected between an interconnection point between the fourth and fifth semiconductor devices and the negative side of the second direct-current power supply, a back gate of the fourth semiconductor device connected to the positive side of the third direct-current power supply, and back gates of the fifth and sixth semiconductor devices connected to the negative side of the second direct-current power supply, thereby to selectively form a conduction path for electric charging/discharging to/from the other end of the actuator.

* * * * *